US006286595B1

(12) United States Patent
Oxnevad et al.

(10) Patent No.: US 6,286,595 B1
(45) Date of Patent: Sep. 11, 2001

(54) TUBING SYSTEM FOR AN OIL OR GAS WELL

(75) Inventors: David Gardner Oxnevad; Nils Reimers, both of Stavanger; Terje K. Bjerkeli, Bekkestua; Morten Talgo, Sandnes; Truls Fallet, Olso, all of (NO)

(73) Assignee: Maritime Well Service AS, Stavanger (NO)

( * ) Notice: Subject to any disclaimer, the term of this patent is extended or adjusted under 35 U.S.C. 154(b) by 0 days.

(21) Appl. No.: 09/381,207

(22) PCT Filed: Mar. 10, 1998

(86) PCT No.: PCT/NO98/00080

§ 371 Date: Sep. 17, 1999

§ 102(e) Date: Sep. 17, 1999

(87) PCT Pub. No.: WO98/41731

PCT Pub. Date: Sep. 24, 1998

(30) Foreign Application Priority Data

Mar. 20, 1997 (NO) ..... 971320

(51) Int. Cl.[7] ..... E21B 23/01

(52) U.S. Cl. ..... 166/242.7; 166/65.1; 166/196; 166/208

(58) Field of Search ..... 166/208, 98, 382, 166/65.1, 196, 242.6, 242.7, 66.6, 386; 294/86.16, 86.24, 86.1

(56) References Cited

U.S. PATENT DOCUMENTS

| | | | | |
|---|---|---|---|---|
| 4,325,579 | | 4/1982 | Kwantes et al. . | |
| 4,852,648 | | 8/1989 | Akkerman et al. | 166/66.4 |
| 5,413,176 | | 5/1995 | Restarick . | |
| 5,455,573 | * | 10/1995 | Delatorre | 340/854.8 |
| 5,547,029 | | 8/1996 | Rubbo et al. | 166/375 |
| 5,743,335 | * | 4/1998 | Bussear | 166/285 |
| 5,884,702 | * | 3/1999 | Yokley et al. | 166/290 |
| 6,021,095 | * | 2/2000 | Tubel et al. | 367/82 |

FOREIGN PATENT DOCUMENTS

| | | |
|---|---|---|
| 0 617 195 A3 | 9/1994 | (EP) . |
| 300392 | 5/1997 | (NO) . |

* cited by examiner

*Primary Examiner*—David Bagnell
*Assistant Examiner*—Zakiya Walker
(74) *Attorney, Agent, or Firm*—Smith, Gambrell & Russell LLP

(57) ABSTRACT

A tubing system for use in an oil or gas well includes a tubing, provided with a holder portion; a casing, around the tubing; a packer, disposed in an annulus defined by the tubing and the casing; and a telescopic extension, positioned within the tubing and extendable beyond a distal portion of the tubing. The telescopic extension is provided with structures for fastening the telescopic extension to the holder portion of the tubing, and structures for accepting a tool by which the telescopic extension is axially displaceable to withdraw the telescopic extension from the distal portion of the tubing. The tubing system is further provided with a first part of a coupling, in the holder portion of the tubing, provided with lines which pass through a portion of the annulus above the packing to communicate with equipment on the surface; and a second part of the coupling, in the telescopic extension, provided with lines which pass within the telescopic extension to equipment provided within a length of the telescopic extension. In the embodiments described, the lines of the tubing system can be electric conductors or hydraulic lines.

10 Claims, 1 Drawing Sheet

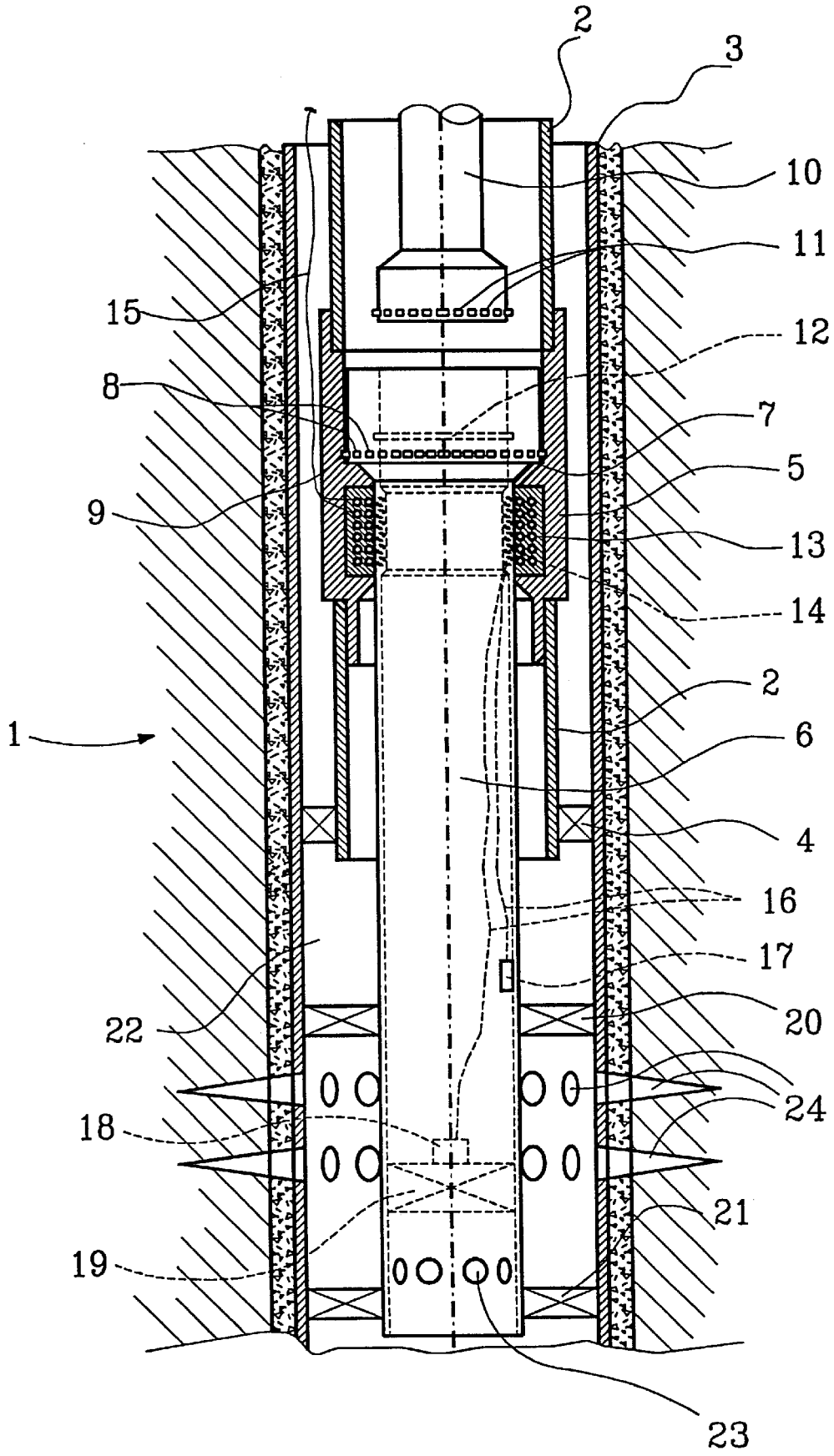
2
3
10
11
15
12
8
7
5
9
13
14
2
1
6
4
16
17
22
20
24
18
21
19
23

TUBING SYSTEM FOR AN OIL OR GAS WELL

BACKGROUND OF THE INVENTION

1. Field of the Invention

The invention relates to a device by tubing in an oil well or a gas well, hereinafter only referred to as a well.

2. Description of the Related Art

In the production of oil and gas, oil/gas is led to the surface through so-called tubing in a well. At the surface, at the upper end of the tubing, comprehensive valving and safety equipment are arranged thereto. Somewhat away from its lower end, the tubing has a seal arranged thereto, the so-called packer, which is arranged to seal between the tubing and the wall of the well, which is normally lined with a steel tube also called casing, so that oil or gas cannot enter the annulus outside the tubing. Between said packer and the lower end of the well, the casing is perforated, so that oil or gas may flow into the well, further up into the tubing and to the surface. In the annulus outside the casing and between the packer and the lower end of the casing, a filter, for example a gravel pack, may be provided, which is to prevent sand from the reservoir from being carried by the gas or oil flow.

The lower end of the casing which is in the productive zone of the well, i.e. the part of the casing located between the packer and the bottom of the well, is of particular interest and calls for attention for several reasons. It is desirable to be able to decide which part of the reservoir to produce from. This is decided partly by positioning the perforations in the right area of the casing. It is typical to carry out perforation in several turns to exploit the reservoir, zone by zone, in the course of time. There may also be drilled extensions from the lower part of the casing out into the reservoir. It is further known to install zone defining packers in the annulus between the casing and the wall of the well. By installing plugs and chokes, maybe choke valves, within the lower part of the casing, the production from the reservoir may be controlled, so that the reservoir is drained in the optimal manner.

To monitor the production and ensure optimal conditions, it is known to arrange downhole sensors to observe pressure, temperature, water content in the oil/gas, detect sand and other items. The sensors should be placed in the productive part of the well, i.e. between the packer and the bottom of the well.

Sensor signals are transferred to the surface through lines running in the annulus outside the tubing. The sensors are installed at the same time as the tubing, and the lines are secured to the exterior of the tubing. Possible actuators for downhole valves are energized by lines from the surface and are controlled from the surface, either by controlling the energy supply or through particular control signals. Both electric and hydraulic lines may be of interest.

Deposits occur in the tubing, particularly in the lower part of the tubing. In connection with well maintenance it is of current interest to perform mechanical cleaning inside the tubing. Sensors, actuators, chokes and other equipment must either be arranged to bear and give room for such cleaning, or the equipment must be removed before cleaning is started.

The packer is of great importance in terms of safety, and quite naturally there are strict requirements to the packer itself and to the setting of it. The packer may not be removed, unless other satisfactory security is provided.

When equipment, to be connected to lines from the surface, is placed closer to the well bottom than the packer, problems arise in passing the lines past the packer. The lines may be taken through the packer itself, but this requires particular measure. The lines may be taken through the tubing wall further away from the end of the tubing than where the packer is, and back out, nearer the end of the tubing. The lines will then run inside the tubing a short distance, and will then be highly exposed. Therefore, it is a better solution to pass the lines past the packer in channels in the tube wall itself. Still, a sealing problem will arise, as oil and gas may then enter the annulus between the packer and the surface. Sensors and other equipment, to be connected to lines and placed closer to the well bottom than the packer, must be installed at the same time as the tubing. Maintenance of such equipment often involves that the tubing must be extracted from the well, which is, of course, both complex and expensive.

A superior object of the invention is, therefore, to simplify the maintenance and use of equipment in an area between the packer and the well bottom. In particular it is an object to simplify installation and maintenance of equipment which is to be connected to lines in said area.

BRIEF SUMMARY OF THE INVENTION

The aims are reached through features as defined in the following description and subsequent claims.

According to the invention, the well is provided with a tubing which in a known manner has a packer arranged thereto. A telescopic extension of the tubing is arranged to permit connection to a holder inside the tubing, so that the telescopic part projects from the lower end of the tubing. The telescopic part maybe released from the holder and be extracted from the well for maintenance. Sensors, chokes, valves and actuators and other equipment may be mounted in the telescopic part before the latter is run into the well.

According to the invention, lines belonging to said sensors and actuators are terminated in a part of a coupling which is arranged to co-operate with a complementary connection part in the tubing. The lines may with advantage be passed in particular channels in the body material of the telescopic part.

Said complementary connection part is arranged to the tubing further from the well bottom than where the packer is. The complementary connection part is connected to lines which are passed, in a known manner, in the annulus outside the tubing to equipment on the surface.

When the telescopic part is inserted into the well and secured to the holder in the tubing, said connection establishes communication between the sensors and the actuators.

BRIEF DESCRIPTION OF THE DRAWING

The invention will be described in the following by means of a non-limiting example of an embodiment with reference to the accompanying drawing, in which FIG. 1 shows a simplified side view of part of a vertical well with tubing provided with a lower telescopic part.

DETAILED DESCRIPTION OF THE INVENTION

In the figure reference numeral 1 defines a well, in which a tubing 2 is arranged in a manner known in itself. The well 1 is shown having a casing 3 which is fixed through cementation and is perforated in its lower part. A packer 4 is in an ordinary manner set between the tubing 2 and the casing 3.

In the tubing 2 is interposed a holder 5 carrying a telescopic part 6 which projects from the lower part of the tubing 2. The telescopic part 6 is stepped and rests on a shoulder 7 of the holder 5. Further, the telescopic part 6 is provided, in a manner known in itself, with grippers 8 which are arranged to allow radial displacement thereof to engage an annular groove 9 in the holder 5 and thereby lock the telescopic part to the holder 5. The grippers 8 are arranged so that they can be triggered to release the telescopic part 6 from the holder 5 by means of a tool 10, which is arranged to be releasably connected to the upper end of the telescopic part 6.

The tool 10 is provided with a set of external locking pins 11 which are arranged to engage an internal locking groove at the upper end of the telescopic part 6.

The grippers 8 and the locking pins 11 with complementary recesses 9, 12 may, with advantage, be made in accordance with known principles, which are used for grippers and locking pins of known equipment and tools.

In the holder 5 is provided a first part 13 of an inductive coupling which is arranged to be able to cooperate with a second part 14 of said inductive coupling. The first part 13 of the inductive coupling 13, 14 has a first set of electric conductors 15 arranged thereto, for transferring energy and electric signals between the first part 13 of the inductive coupling 13, 14 and not shown equipment on the surface. The second part 14 of the inductive coupling 13, 14 is electrically connected to a sensor 17 and an actuator 18, which has an adjustable choke valve 19 in the telescopic part 6, by means of a second set of electric conductors 16. Electric signals are transferred between the sensor 17 and the actuator 18 via the electric conductors 15, 16 and the inductive coupling 13, 14.

Conductive, electric couplings may also be provided, for example through plugable electric connectors in the bearing surface by the shoulder 7. Instead of, or in addition to, said electric connectors, a person skilled in the art may easily arrange hydraulic connections for the transfer of hydraulic energy and hydraulic signals between the holder 5 and the telescopic part 6. The first set of electric and/or hydraulic lines 15 may in a known manner be passed in the annulus outside the tubing 2 and above the packer 4. The second set of lines 16 may, with advantage, be passed in now shown channels in the body material of the telescopic part 6.

Seals 20, 21 define a zone in an annulus 22 below the end of the tubing 2 and outside the telescopic part 6, which is shown to be sealed at its lower end. A set of ports 23 in the telescopic part 6 is arranged to direct oil or gas from the defined zone of the annulus 22 into the telescopic part 6 below the choke valve 19, as the well 1 is provided with perforations 24. Production of oil/gas may be controlled from the surface by remote control of the choke 19 based on signals from the sensor 17. As required, more sensors, more valves, more zone-defining seals and more sets of ports may be provided in the telescopic part 6.

Whenever there is a need for maintenance of the telescopic part 6 or of equipment provided in the telescopic part 6, the tool 10 is inserted into the well 1 and connected to the upper end of the telescopic part 6, so that the locking pins 11 engage the locking recess 12. Thereby the grippers 8 are passed out of the groove 9 of the holder 5, and the telescopic part 6 may be pulled up and out of the well 1, hanging from the tool 10. When the telescopic part 6 is ready for use, it is lowered into the well 1, hanging from the tool 10, until the telescopic part 6 lands on the shoulder 7 of the holder 5. The locking pins 11 are released so that the tool 10 may be pulled up and out from the telescopic part 6. Thus, the grippers 8 are activated to engage the groove 9, so that the telescopic part 6 is locked to the holder 5.

What is claimed is:

1. A tubing system for use in an oil or gas well, comprising:

a tubing, provided with a holder portion;

a casing, around the tubing;

a packer, disposed in annulus defined by the tubing and the casing;

a telescopic extension, positioned within the tubing and extendable beyond a distal portion of the tubing, the telescopic extension provided with:

means for fastening the telescopic extension to the holder portion of the tubing, and means for accepting a tool by which the telescopic extension is axially displaceable to withdraw the telescopic extension from the distal portion of the tubing;

a first part of a coupling, in the holder portion of the tubing, provided with lines which pass through a portion of the annulus above the packer to communicate with equipment on the surface; and a second part of the coupling, in the telescopic extension, provided with lines which pass within the telescopic extension to equipment provided within a length of the telescopic extension.

2. The tubing system according to claim 1, wherein the telescopic extension is stepped and rests on a shoulder of the holder.

3. The tubing system according to claim 1, wherein the means for fastening the telescopic extension to the holder portion of the tubing comprises:

grippers, arranged about the telescopic extension, which are radially displaceable; and an annular groove, provided about an inner portion of the holder, which accepts the grippers, when the grippers are radially displaced, to thereby lock the telescopic extension to the holder.

4. The tubing system according to claim 3, wherein the grippers are arranged so that the tool, by which the telescopic extension is axially displaceable to withdraw the telescopic extension from the distal portion of the tubing, can trigger the grippers to release the telescopic extension from the holder.

5. The tubing system according to claim 1, further comprising the tool, by which the telescopic extension is axially displaceable to withdraw the telescopic extension from the distal portion of the tubing, releasably connected to an upper portion of the telescopic extension.

6. The tubing system according to claim 5, wherein the tool, by which the telescopic extension is axially displaceable to withdraw the telescopic extension from the distal portion of the tubing, is provided with a set of external locking pins which are arranged to releasably engage an internal locking groove at an upper portion of the telescopic extension.

7. The tubing system according to claim 1, wherein the lines of the first part of the coupling comprise electric conductors for transferring electric signals between the coupling and the equipment on the surface, and wherein the lines of the second part of the coupling comprise electric conductors for transferring electric signals between the coupling and the equipment provided within the length of the telescopic extension.

8. The tubing system according to claim 7, wherein the equipment provided within the length of the telescopic extension comprises a sensor and an actuator having an adjustable choke valve.

9. The tubing system according to claim 1, wherein the lines of the first part of the coupling comprise hydraulic lines for hydraulically connecting the coupling to the equipment on the surface, and wherein the lines of the second part of the coupling comprise hydraulic lines for hydraulically connecting the coupling to the equipment provided within the length of the telescopic extension.

10. The tubing system according to claim 1, wherein the lines of the second part of the coupling pass through channels provided within a body of the telescopic extension.

* * * * *